US008840278B2

(12) United States Patent
Pickard

(10) Patent No.: US 8,840,278 B2
(45) Date of Patent: Sep. 23, 2014

(54) SPECULAR REFLECTOR AND LED LAMPS USING SAME

(75) Inventor: Paul Kenneth Pickard, Morrisville, NC (US)

(73) Assignee: Cree, Inc., Durham, NC (US)

( * ) Notice: Subject to any disclaimer, the term of this patent is extended or adjusted under 35 U.S.C. 154(b) by 310 days.

(21) Appl. No.: 13/236,792

(22) Filed: Sep. 20, 2011

(65) Prior Publication Data

US 2013/0070461 A1 Mar. 21, 2013

(51) Int. Cl.
*F21V 7/22* (2006.01)

(52) U.S. Cl.
CPC ..... *F21V 7/22* (2013.01)
USPC ..... 362/297; 362/346; 362/296.01; 362/341

(58) Field of Classification Search
USPC ..... 362/296.01, 297, 341, 346, 350, 516
See application file for complete search history.

(56) References Cited

U.S. PATENT DOCUMENTS

| | | | | |
|---|---|---|---|---|
| 5,136,483 | A * | 8/1992 | Schoniger et al. | 362/545 |
| 2003/0043586 | A1 | 3/2003 | Sagal et al. | |
| 2005/0185409 | A1* | 8/2005 | Mayer | 362/350 |
| 2005/0230691 | A1* | 10/2005 | Amiotti et al. | 257/79 |
| 2010/0254128 | A1 | 10/2010 | Pickard et al. | |
| 2010/0290222 | A1 | 11/2010 | Pickard et al. | |
| 2011/0096548 | A1 | 4/2011 | Pickard | |
| 2011/0175533 | A1* | 7/2011 | Holman et al. | 315/130 |
| 2011/0204261 | A1* | 8/2011 | Dahm et al. | 250/492.1 |

FOREIGN PATENT DOCUMENTS

| | | | |
|---|---|---|---|
| EP | 0326276 | A2 | 8/1989 |
| EP | 0516489 | A2 | 6/1992 |
| EP | 0751339 | A2 | 1/1997 |
| EP | 1253373 | A2 | 10/2002 |

OTHER PUBLICATIONS

Cree, Inc., International Application No. PCT/US2012/054991, International Search Report and Written Opinion, Apr. 5, 2013.
U.S. Appl. No. 13/167,351, filed Jun. 23, 2011.

* cited by examiner

*Primary Examiner* — Laura Tso
(74) *Attorney, Agent, or Firm* — Steven B. Phillips; Moore & Van Allen PLLC

(57) ABSTRACT

A specular reflector and LED lamps using embodiments of the reflector are disclosed. Embodiments of the invention provide a reflector for solid state lamps. The reflector can be a specular reflector. The reflector includes a rigid, polymeric substrate and sputtered metal applied to the substrate. In some embodiments, the metal is silver. In some embodiments, the metal is applied without an intervening base coat. In some embodiments, the substrate is made from or includes an aromatic polyester such as polyarylate. The reflector can include a discontinuous or irregular surface yet still exhibit very high overall reflectivity and efficiency because the metal can be applied without an intervening base coat. In some embodiments, the reflector is used in lamps having a retroreflective optical design.

34 Claims, 7 Drawing Sheets

SPECULAR REFLECTOR AND LED LAMPS USING SAME

BACKGROUND

Light emitting diode (LED) lighting systems are becoming more prevalent as replacements for existing lighting systems. LEDs are an example of solid state lighting (SSL) and have advantages over traditional lighting solutions such as incandescent and fluorescent lighting because they use less energy, are more durable, operate longer, can be combined in red-blue-green arrays that can be controlled to deliver virtually any color light, and generally contain no lead or mercury. In many applications, one or more LED dies (or chips) are mounted within an LED package or on an LED module, which may make up part of a lighting unit, lamp, "light bulb" or more simply a "bulb," which includes one or more power supplies to power the LEDs. An LED bulb may be made with a form factor that allows it to replace a standard threaded incandescent bulb, or any of various types of fluorescent lamps. LEDs can also be used in place of florescent lights as backlights for displays.

Many LED lamps use a reflector or a combination of reflectors to bounce light off a surface or surfaces before it is emitted from the lamp. This bouncing has the effect of disassociating the emitted light from its initial emission angle. Typical direct view lamps emit both uncontrolled and controlled light. Uncontrolled light is light that is directly emitted from the lamp without any reflective bounces to guide it. According to probability, a portion of the uncontrolled light is emitted in a direction that is useful for a given application. Controlled light can be directed in a certain direction with reflective surfaces. The mixture of uncontrolled and controlled light defines the output beam profile. In a "retroreflective" arrangement, light from the source either bounces off an outer reflector (single bounce) or it bounces first off an inner or secondary reflector and then off of the outer reflector (double bounce). Thus, most of the light is redirected before emission and controlled.

A reflector for a solid-state lamp can be constructed in various ways. Sheet metal such as aluminum can be used. A reflective film fastened to a substrate with adhesive can also be used to form a reflector. Vacuum metalized plastic (PVD) is commonly used in lighting because of its low cost and relatively good performance. Sputtered metal coating affords the opportunity to provide high reflectivity by using highly reflective metal such as silver as the sputtered metal. A base coat is applied to the plastic prior to sputtering. The thickness of the base coat can obscure fine details of the reflector, so that sputtered metal coated plastic may not be suitable for reflectors with complex surfaces.

SUMMARY

Embodiments of the invention provide a reflector for solid state lamps. In example embodiments, the reflector can be formed from a polymer-based substrate with a sputtered metal coating. The substrate used with example embodiments of the invention can include a discontinuous or irregular surface, that is, a surface with discontinuities such as creases and bends. However, the reflector made according to some embodiments of the invention can exhibit very high overall reflectivity despite these discontinuities, because the metal can be applied without an intervening base coat. Thus, optical efficiency can be improved, while still forming the reflector primarily from molded plastic. In other embodiments, silver can be used with or without an intervening base coat to provide high reflectivity in a retroreflector.

A reflector according to example embodiments of the invention can be shaped to receive light from at least one LED. The reflector can be a specular reflector. The reflector includes a rigid, polymeric substrate and sputtered metal applied to the substrate. In some embodiments, the metal is applied without an intervening base coat. In some embodiments, the substrate is made from or includes thermoset. In some embodiments, the substrate is made from or includes aromatic polyester. In some embodiments, the aromatic polyester is polyarylate. In some embodiments, the substrate is made from or includes polyetherimide. In some embodiments, the lack of an intervening base coat allows the metal to more closely replicate the discontinuous surface of the substrate than would otherwise be possible. In some embodiments, the sputtered metal imparts a surface reflectivity of at least 94% or at least 95% to the reflector.

In some embodiments, silver is used as the sputtered metal. Silver can be used with or without an intervening base coat. In some embodiments, such a reflector can be deployed as a retroreflector. A retroreflector can be any reflector that is used to reflect light from the front hemisphere of the source back through the envelope of the source, effectively changing the source to a single hemisphere emitter. If silver is used with a base coat, the substrate can be made of any of a wide variety of materials including polycarbonate, ABS and ABS/polycarbonate, in addition to the polymers already mentioned.

In some embodiments, the reflector is used in a lamp with a light source including at least one LED. The lamp further includes a power supply electrically connected to the light source and the reflector disposed to receive light from the light source. In some embodiments, the light engine of the lamp includes the reflector and the LED light source arranged in a retroreflective configuration. In some embodiments, a secondary reflector is included to reflect light into a primary specular reflector. The lamp can be assembled by providing a polymeric substrate that can be metalized without a base coat and sputtering a reflective metal onto the substrate. The parts of the lamp are interconnected so that the LED light source emits light into a specular reflector according to an embodiment of the invention, either with or without bouncing from an additional reflector. A power supply in the lamp is connected to the LED light source to energize an LED or a plurality of LEDs.

DETAILED DESCRIPTION

Figure 1A:
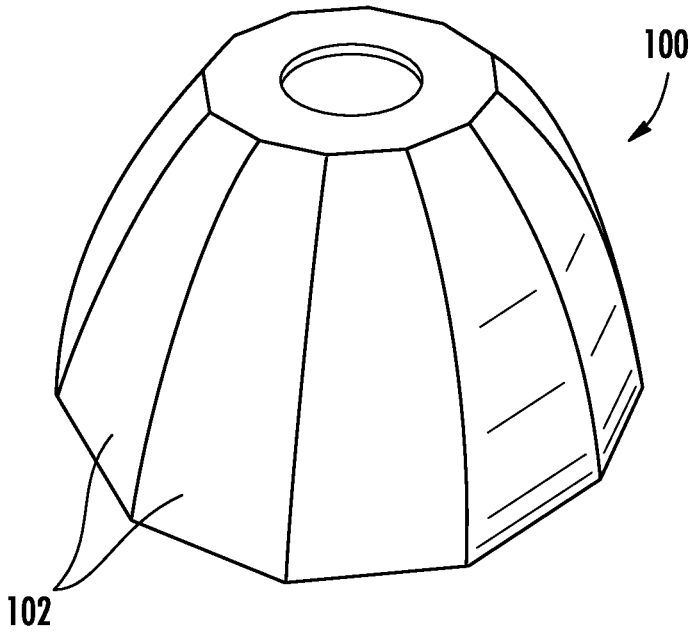
FIGS. 1A and 1B show perspective views of a highly reflective, specular reflector according to example embodiments of the present invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

Figure 1B:
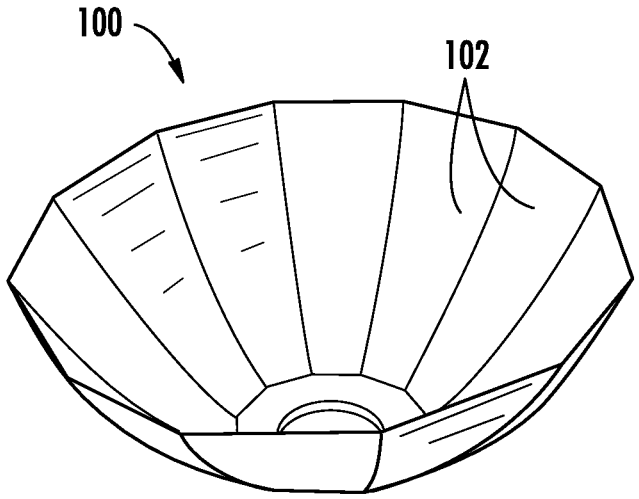

FIGS. 1A and 1B show two perspective views of a reflector according to example embodiments of the invention. Highly reflective specular reflector 100 does not have a smooth bowl-shape often seen in reflectors for lamps. Rather, reflector 100 features a segmented structure or faceted structure with a plurality of adjoining panels 102. Thus, reflector 100 has as discontinuous surface, in that there are creases or sharp bends where the panels 102 come together around the reflector. The highly reflective specular reflector of FIGS. 1A and 1B in some applications may serve as a highly reflective, specular retroreflector.

Figure 2:
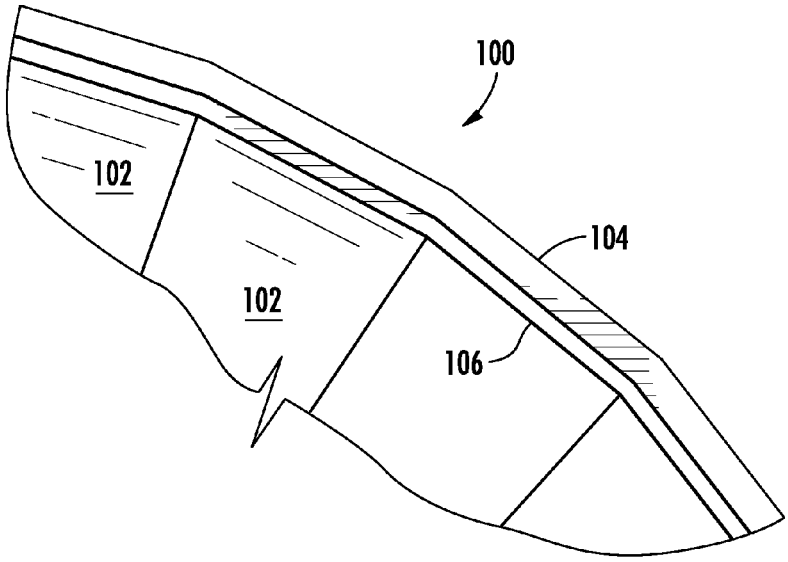
FIG. 2 shows a magnified view of the edge of the reflector of FIGS. 1A and 1B, with the thickness of the sputtered metal being exaggerated for clarity.

FIG. 2 is a close-up view of the edge of reflector 100 of FIGS. 1A and 1B. In FIG. 2, rigid, polymeric substrate 104 defines the basic shape of the reflector. A layer 106 of sputtered metal has been applied to substrate 104 without an intervening base coat. Thus, the metal surface of the final reflector more closely replicates the discontinuous surface of the substrate than would be possible with a base coat, since the base coat would tend to fill in the creases between facets. Since the discontinuous surface of the reflector is optically engineered, a high reflectivity can be maintained because losses caused by light being scattered by the surface where creases would be filled in by a base coat can be minimized. In some embodiments, an average surface reflectivity of at least 95% can be maintained across the reflective surface. In other embodiments a surface reflectivity of at least 90%, at least 94%, at least 95%, at least 96%, or at least 97% can be maintained. The thickness of the sputtered metal layer in FIG. 2 as well as the thicknesses and sizes of other portions of all the drawings herein may be exaggerated for clarity. Such features are not necessarily shown to scale in any of the drawings. A reflector made in this way may be deployed as a retroreflector. A reflector that is used to reflect the light from the front hemisphere of the source back through the envelope of the source, effectively changing the source to a single hemisphere emitter, may be referred to as a retroreflector, regardless of whether it is deployed as a primary or secondary reflector. The light engine of such a lamp using such a reflector may be said to be arranged in a retroreflective configuration.

Embodiments of the invention can make use of a plastic that can be metalized directly without a base coat. In some embodiments, an aromatic polyester is used. One appropriate polyester is known as "polyarylate" (PAR), CAS Registry No. 26590-50-1. Polyarylate is commercially available from Plastics International, Inc. of Eden Prairie, Minn. in the United States and from Unitika, Ltd. in Uji City, Japan. A cured thermosetting polymer ("thermoset") can also be used for a reflector according to example embodiments of the invention. A thermoset, once cured, is an infusible, insoluble polymer network. Alternatively, a polyetherimide, CAS Registry No. 61128-46-9, can be used, for example, Ultem™ from Sabic Innovative Plastics of Pittsfield, Mass. in the United States.

Figure 3A:
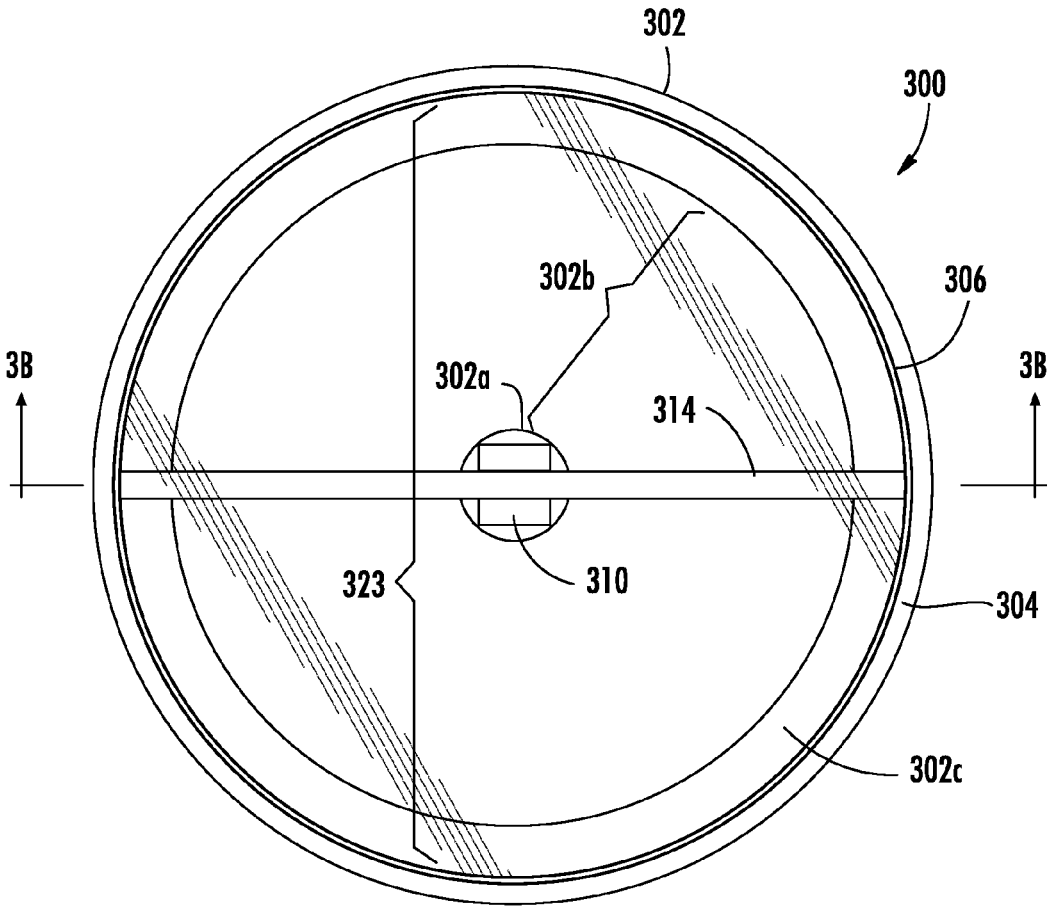
FIGS. 3A and 3B show a top view and a cross-sectional view, respectively, of a light engine for a lamp that makes use of a reflector according to another example embodiment of the invention.
Figure 3B:
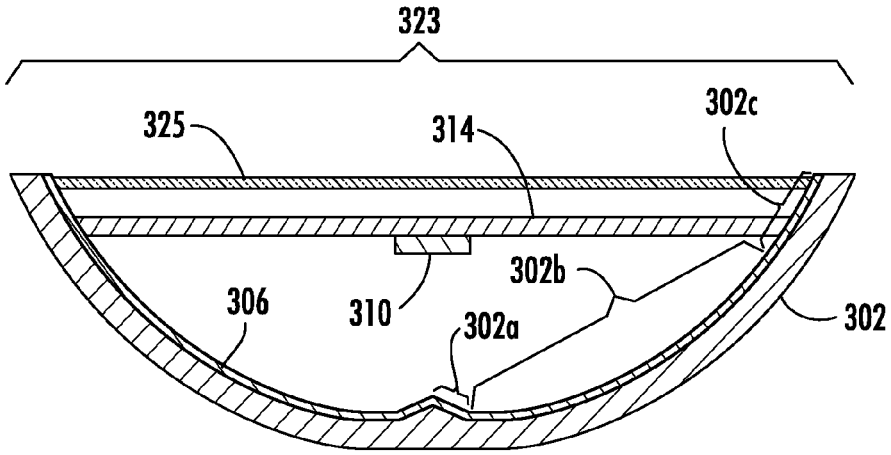

FIGS. 3A and 3B illustrate a light engine for an LED lamp that includes a specular reflector 302 and an LED light source arranged in a retroreflective configuration. The LED light source is positioned at the open end of the reflector and shines into the reflector. Thus, reflector 302 might be termed a "retroreflector". In this example, the surface of the reflector is discontinuous because it has three distinct angular regions, with relatively sharp bends in between. Light engine 300 is shown from the top in FIG. 3A, and a cross-section is shown in FIG. 3B. The specular reflector 302 in light engine 300 again includes a polymeric substrate 304 with a sputtered silver coating 306, applied without an intervening base coat.

Still referring to FIGS. 3A and 3B, the light engine includes a light source 310. Reflector 302 comprises a first reflector region 302*a*, a second reflector region 302*b* and a third reflector region 302*c*. The light source 310 is aimed at the reflector 302, and can be suspended on a bridge 314 that extends diametrically across the aperture 323. Light engine 300 can further include a transparent lens 325 that covers the aperture 323. The light source 310 can include a multi-chip LED package that emits light that is perceived by humans as white light.

Figure 4:
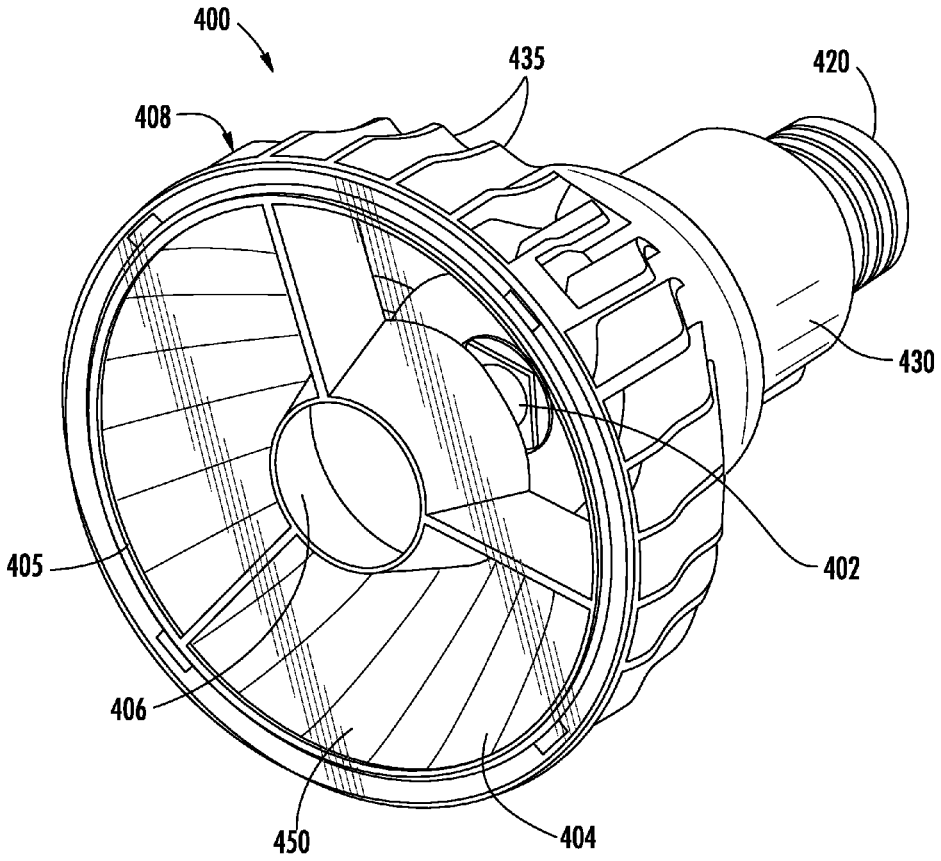
FIG. 4 shows a perspective view of a lamp using a retroreflector according to example embodiments of the invention.

FIG. 4 is a perspective view of a lamp 400 according to embodiments of the invention. This particular example LED lamp has a form factor to allow it to act as a replacement for a standard "BR" type bulb with an Edison base, such as a BR30. An LED light source 402 is disposed at the base of a bowl-shaped region within the lamp 400. Many applications, for example white light applications, necessitate a multicolor source to generate a blend of light that appears as a certain color to the human eye. In some embodiments multiple LEDs or LED chips of different colors or wavelength are employed, each in a different location with respect to the optical system. Because these wavelengths are generated in different locations and therefore follow different paths through the optical system, it is necessary to mix the light sufficiently so that color patterns are not noticeable in the output, giving the appearance of a homogenous source. Furthermore, even in embodiments wherein homogenous wavelength emitters are employed, it is advantageous to mix light from different locations in order to avoid projecting an image of the optical source onto the target.

Still referring to FIG. 4, specular reflector 404 includes sputtered silver 405 applied to a polymeric substrate as previously described. Reflector 404 is similar to the reflector shown in FIG. 1, except that reflector 404 has more facets. A secondary reflector 406 (which is a retroreflector in this case) is disposed proximate to the LED light source 402. Some of the light emitted from the source 402 interacts with the retroreflector 406 such that the light is reflected into specular reflector 404. Thus, the retroreflector 406 and the specular reflector 404 work in concert to shape the light into a beam having characteristics that are desirable for a given application. Note that retroreflector 406 may also be a specular reflector, either made in accordance with the reflector described in FIGS. 1 and 2 or made in some other way. A protective housing 408 surrounds the light source and the reflectors. In this example embodiment, lamp 400 also includes an Edison base 420, and a power supply within power supply section 430 of the lamp. The LED light source 402 and the power supply are in thermal contact with the housing so that fins 435 provide cooling. A lens 450 covers the open end of the housing and provides protection from outside elements. The LED light source and the power supply are electrically connected so that the power supply can energize the LEDs.

Figure 5:
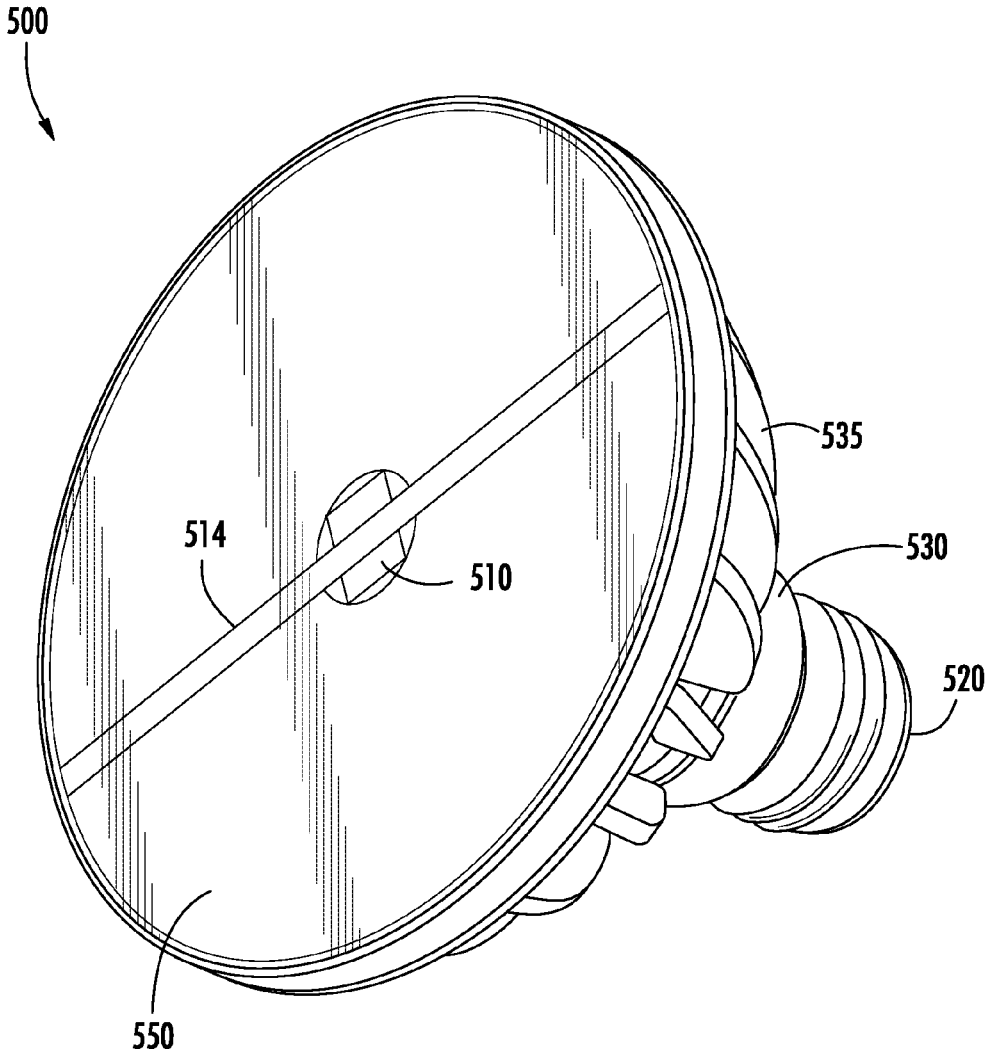
FIG. 5 shows a perspective view of another lamp using a retroreflector according to example embodiments of the invention.

FIG. 5 is a perspective view of another LED lamp according to embodiments of the invention. In this particular example, lamp 500 has the form factor of a standard "PAR" type bulb, such as a PAR20, PAR30 or PAR38. The LED light source 510 is positioned at the open end of the reflector and shines into the reflector. In this example, the reflector (not visible) is discontinuous and similar to the reflector shown in FIGS. 3A and 3B. The specular reflector again includes a polymeric substrate with a sputtered silver coating, applied without an intervening base coat. Light source 510 is suspended on a bridge 514 that extends over the aperture. The light source 510 can include a multi-chip LED package that emits light that is perceived by humans as white light.

In the example embodiment of FIG. 5, lamp 500 also includes an Edison base 520, and a power supply within power supply section 530 of the lamp. Fins 535 provide cooling. A lens 550 covers the open end of the housing and provides protection from outside elements. The LED light source and the power supply are electrically connected so that the power supply can energize the LEDs. It should be noted that the example BR and PAR type lamps illustrated herein are examples only. An embodiment of the invention can find use in many types of solid state lamps, including those with form factors to replace "R" type bulbs such as the R20, R30 and R40; "ER" type such as the ER30 or ER40; and "MR" type lamps such as the MR16.

Figure 6:
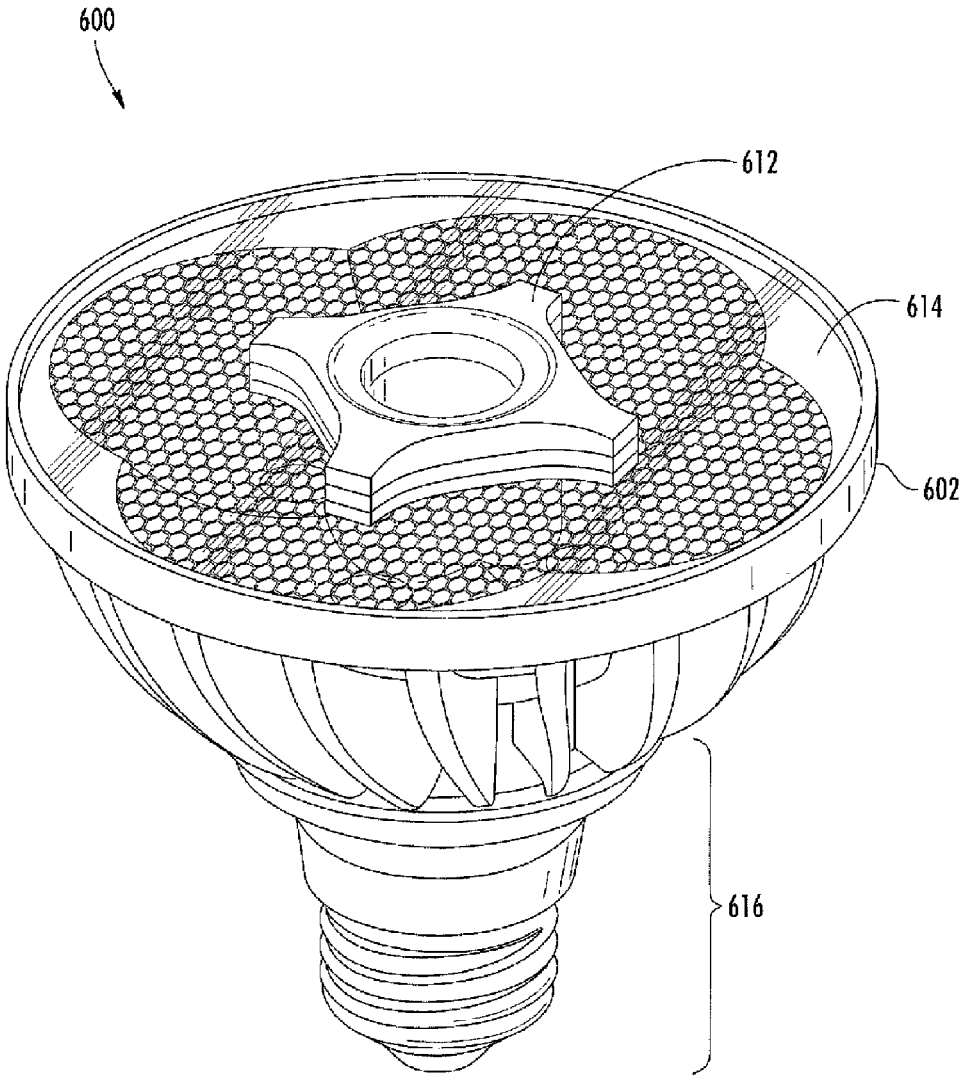
FIG. 6 is a perspective view of a lamp using a retroreflector according to additional example embodiments of the invention.
Figure 7:
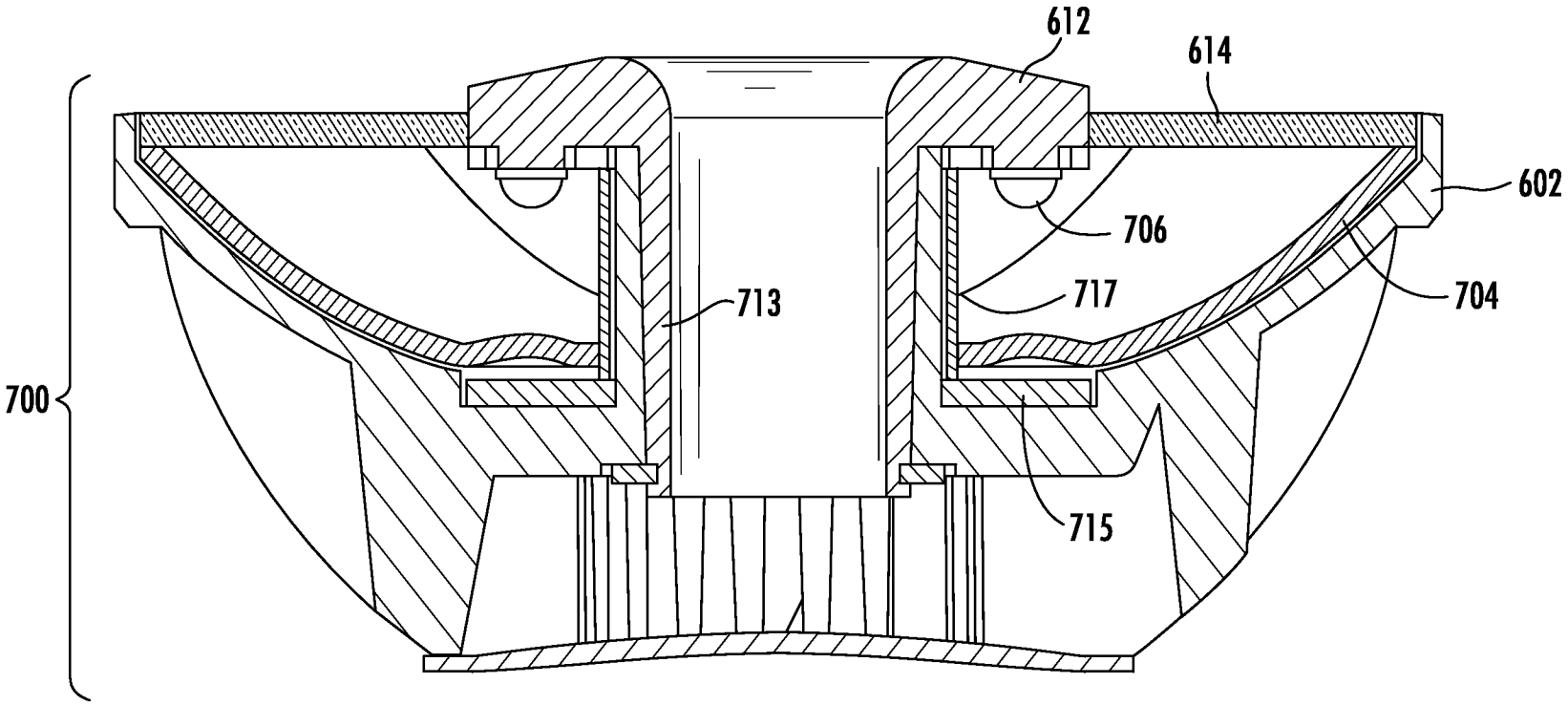
FIG. 7 is a cross-sectional view of the light engine of the lamp of FIG. 6.

Another LED lamp according to example embodiments of the invention is illustrated in FIGS. 6 and 7. FIG. 6 is a perspective view of lamp 600. FIG. 7 is a cross-sectional view of light engine 700 from lamp 600. Lamp 600 may include a housing 602, a retroreflector 704, LED light sources 706, a metal heat spreader 612, a lens 614, and a power supply housing 616. LED light sources 706 are positioned in the lamp 600 such that when energized, the one or more LED light sources 706 direct light rays toward the retroreflector 704 positioned in an interior of the housing 602.

The retroreflector 704 of FIG. 7 directs the received light rays out of the lens 614 and away from the lamp 600. Due to color mixing features integrated within the lens 614, the front face of the solid state directional lamp appears to have lobed pattern. Retroreflector 704 includes a plastic coated with silver to achieve a surface with high reflectivity. In some embodiments, a surface reflectivity of at least 94%, at least 95%, at least 96%, or at least 97% can be achieved. The silver can be sputtered onto the plastic substrate either with an intervening base coat or without an intervening base coat as previously described. Since silver can maintain a higher reflectivity than other metals, a high reflectivity retroreflector can be obtained by using silver as the sputtered metal in some cases even if a base coat is used. If an intervening base coat is used, plastics such as ABS, polycarbonate, or ABS/polycarbonate could be used, in addition to the plastics that have already been mentioned.

Still referring to FIG. 7, a printed circuit board 715 may be positioned in the housing 602 behind the reflector 704 to mount electrical components used to operate the LED light sources that would otherwise be positioned in power supply housing 616 in order to reduce the size of the power supply housing. Metal heat spreader 612 may contact a back of one or more of the LED light sources 706 in order to assist in dissipating heat generated by the LEDs when energized. In some embodiments, the heat spreader can defines a collar 713 to assist in dissipating heat by providing the metal heat spreader with an increased surface area. The outside of the collar is provided with a reflective film 717 to improve the overall efficiency of lamp 300.

A multi-chip LED package can be used with any embodiment of the invention and can include plural light emitting diode chips that emit respective hues of light that, when mixed, are perceived in combination as white light. Phosphors can also be used. Blue or violet LEDs can be used in the LED assembly of a lamp and the appropriate phosphor can be deployed on a carrier within the lamp structure. LED devices can be used with phosphorized coatings packaged locally with the LEDs to create various colors of light. For example, a blue-shifted yellow (BSY) LED device can be used with a red phosphor on or in the carrier to create substantially white light, or combined with a red emitting LED device to create substantially white light. Such embodiments can produce light with a CRI of at least 70, at least 80, at least 90, or at least 95. By use of the term substantially white light, one could be referring to a chromacity diagram including a blackbody locus of points, where the point for the source falls within four, six or ten MacAdam ellipses of any point in the blackbody locus of points.

The various portions of the light engine and any LED lamps according to example embodiments of the invention can be made of any of various materials. Heat sinks can be made of metal or plastic, as can the various portions of the housings for the components of a lamp. Plastic with enhanced thermal conductivity can also be used to form a heat sink. A lamp according to embodiments of the invention can be assembled using varied fastening methods and mechanisms for interconnecting the various parts. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, bolts, or other fasteners may be used to fasten together the various components.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A reflector shaped to receive light from at least one LED, the reflector comprising:

a rigid, polymeric substrate with a plurality of adjoining panels joined together around the reflector to form a discontinuous surface shaped so that the at least one LED is to be positioned at an open end of the reflector to shine into the reflector; and sputtered metal applied to the substrate without an intervening base coat to maintain a reflectivity of at least 90% across creases formed between the adjoining panels.

2. The reflector of claim 1 wherein the substrate comprises aromatic polyester.

3. The reflector of claim 2 wherein the aromatic polyester is polyarylate.

4. The reflector of claim 3 wherein the substrate includes a discontinuous surface and the sputtered metal replicates the discontinuous surface and imparts a surface reflectivity of at least 95% to the reflector.

5. The reflector of claim 4 wherein the sputtered metal comprises silver.

6. The reflector of claim 1 wherein the substrate comprises at least one of a thermoset and polyetherimide.

7. The reflector of claim 6 wherein the substrate includes a discontinuous surface and the sputtered metal replicates the discontinuous surface and imparts a surface reflectivity of at least 95% to the reflector.

8. The reflector of claim 7 wherein the sputtered metal comprises silver.

9. An LED lamp comprising:

at least one LED to produce light;

a power supply electrically connected to the at least one LED; and a high reflectivity specular retroreflector disposed to receive at least some of the light from the at least one LED, with the at least one LED positioned at an open end of the high-reflectivity specular retroreflector to shine into the high-reflectivity specular retroreflector, the high reflectivity specular retroreflector further comprising a rigid, polymeric substrate with a plurality of adjoining panels joined together around the reflector to form a discontinuous surface and sputtered metal applied to the substrate without an intervening base coat to maintain a reflectivity of at least 90% across creases formed between the adjoining panels.

10. The LED lamp of claim 9 wherein the substrate comprises aromatic polyester, and wherein the sputtered metal is applied to the substrate without an intervening base coat.

11. The LED lamp of claim 10 wherein the aromatic polyester is polyarylate.

12. The LED lamp of claim 11 wherein the substrate includes a discontinuous surface and the sputtered metal replicates the discontinuous surface.

13. The LED lamp of claim 12 wherein the sputtered metal further comprises silver.

14. The LED lamp of claim 13 wherein the average surface reflectivity of the retroreflector is at least 94%.

15. The LED lamp of claim 14 wherein the average surface reflectivity of the retroreflector is at least 95%.

16. The LED lamp of claim 10 wherein the substrate comprises at least one of a thermoset and polyetherimide.

17. The LED lamp of claim 16 wherein the substrate includes a discontinuous surface and the sputtered metal replicates the discontinuous surface so that the average surface reflectivity of the retroreflector is at least 94%.

18. The LED lamp of claim 17 wherein the sputtered metal comprises silver.

19. A method of making a lamp comprising:

providing a rigid, polymeric substrate having a plurality of adjoining panels joined together around the reflector to form a discontinuous surface;

sputtering metal onto the substrate without an intervening base coat so that the metal substantially replicates the discontinuous surface to maintain a reflectivity of at least 90% across creases formed between the adjoining panels to produce a specular reflector;

positioning at least one LED at an open end of the specular reflector so that the at least one LED shines into the specular reflector, which in turn reflects at least a portion of light emitted by the at least one LED; and connecting a power supply to the at least one LED.

20. The method of claim 19 wherein the sputtering of the metal imparts a surface reflectivity of at least 95% to the specular reflector.

21. The method of claim 20 wherein the metal comprises silver.

22. The method of claim 21 wherein the polymeric substrate comprises polyarylate.

23. The method of claim 21 wherein the polymeric substrate comprises at least one of a thermoset and polyetherimide.

24. The method of claim 19 wherein the sputtering of the metal imparts a surface reflectivity of at least 95% to the specular reflector.

25. The method of claim 24 wherein the metal comprises silver.

26. The method of claim 25 wherein the polymeric substrate comprises polyarylate.

27. The method of claim 25 wherein the polymeric substrate comprises at least one of a thermoset and polyetherimide.

28. A retroreflector shaped to receive light from at least one LED, the retroreflector comprising:

a rigid, polymeric substrate having a plurality of adjoining panels joined together around the reflector to form a discontinuous surface shaped so that the at least one LED is to be positioned at an open end of the retroreflector to shine into the retroreflector; and sputtered silver applied to the substrate without an intervening base coat to maintain a reflectivity of at least 90% across creases formed between the adjoining panels.

29. The retroreflector of claim 28 wherein the average surface reflectivity of the retroreflector is at least 94%.

30. The retroreflector of claim 29 wherein the average surface reflectivity of the retroreflector is at least 95%.

31. The retroreflector of claim 29 wherein the substrate comprises at least one of thermoset, polyetherimide, aromatic polyester, polycarbonate, ABS and ABS/polycarbonate.

32. The retroreflector of claim 27 wherein the silver is applied without an intervening base coat.

33. The retroreflector of claim 32 wherein the substrate comprises aromatic polyester.

34. The retroreflector of claim 32 wherein the substrate comprises at least one of polyarylate, thermoset and polyetherimide.

* * * * *